United States Patent [19]

Brown

[11] 4,327,360

[45] Apr. 27, 1982

[54] ALARM DEVICE RESPONSIVE TO MOVEMENT OF PROTECTED OBJECT, POWER SOURCE CONDITION AND ALARM GROUND PATH

[76] Inventor: E. B. Brown, P.O. Box 9772, Fort Worth, Tex. 76107

[21] Appl. No.: 158,045

[22] Filed: Jun. 10, 1980

[51] Int. Cl.[3] ..... G08B 13/14

[52] U.S. Cl. ..... 340/571; 340/650; 340/652; 340/568

[58] Field of Search ..... 340/52.R, 63, 65, 508, 340/568, 571, 650, 652

[56] References Cited

U.S. PATENT DOCUMENTS 3,755,778 8/1973 Kennedy et al. ..... 340/65

3,836,901 9/1974 Matto et al. ..... 340/571

3,924,254 12/1975 Klebold et al. ..... 340/508

4,038,635 7/1977 Schotz ..... 340/63

*Primary Examiner*—Alvin H. Waring

*Attorney, Agent, or Firm*—Sughrue, Mion, Zinn, Macpeak & Seas

[57] ABSTRACT

An alarm adapted to be mounted on an object to be protected is provided with sensing means for sensing any one of (a) a movement of the protected object, (b) a disruption of an applied voltage source, and (c) a disruption of an alarm ground path. The alarm is further provided with signal generating and timing means to produce a two-frequency alarm signal for a selectable length of time.

16 Claims, 1 Drawing Figure

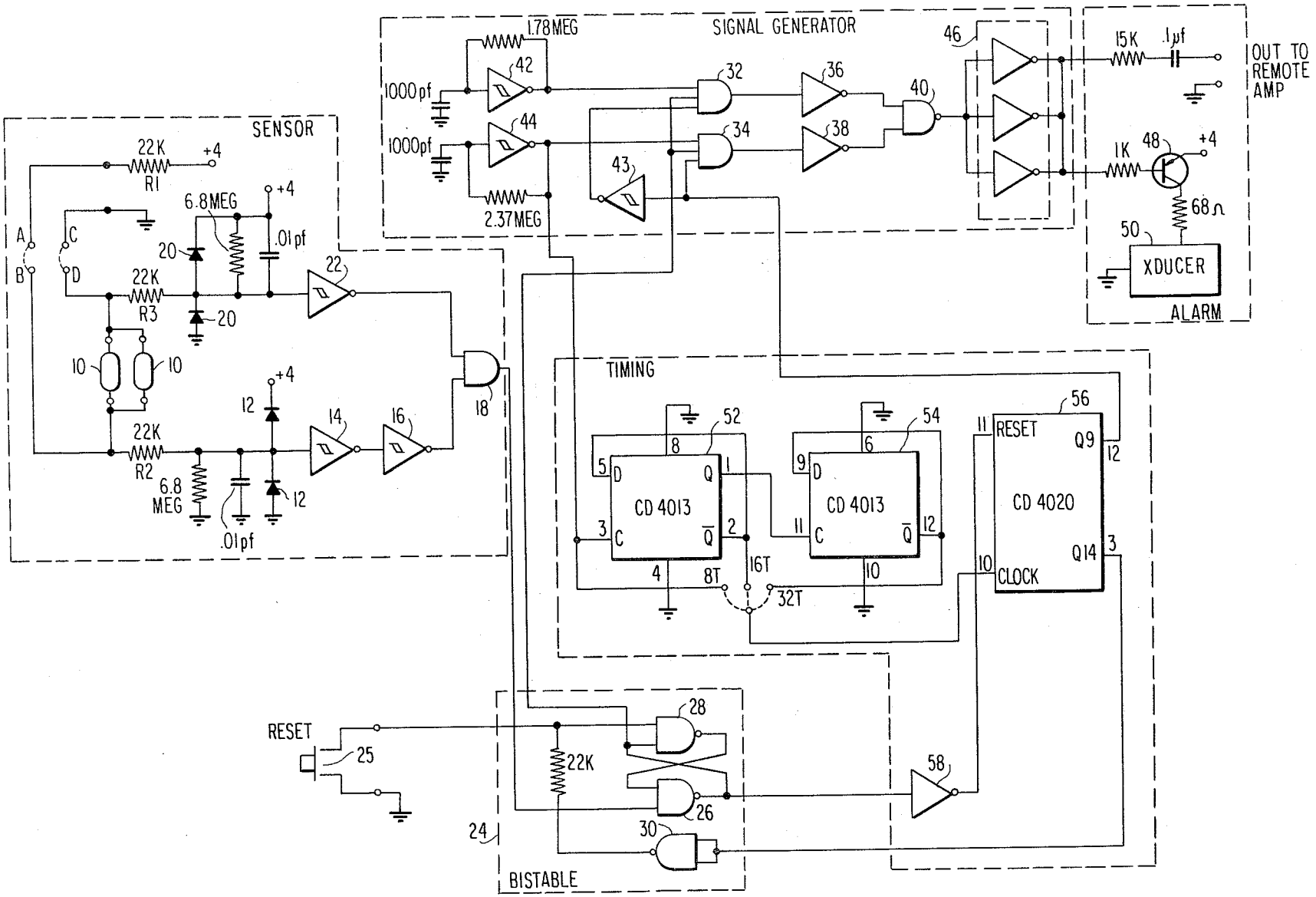
OUT TO REMOTE AMP
.1μf
15K
+4
48
68Ω
1K
XDUCER
50
ALARM
SIGNAL GENERATOR
46
40
36
38
32
34
43
1.78MEG
42
44
2.37MEG
1000pf
1000pf
TIMING
56
CD 4020
Q9
Q14
RESET
CLOCK
54
CD 4013
52
CD 4013
16T
32T
8T
58
BISTABLE
28
26
30
22K
24
18
16
14
22
SENSOR
.01pf
6.8MEG
20
22K R1
22K R3
22K R2
6.8 MEG
10
12
A
B
C
D
RESET
25

ALARM DEVICE RESPONSIVE TO MOVEMENT OF PROTECTED OBJECT, POWER SOURCE CONDITION AND ALARM GROUND PATH

BACKGROUND OF THE INVENTION

The present invention relates to the field of alarm devices which may be mounted on an object to be protected and which are activated in response to one of a plurality of external conditions.

Various alarm devices are known to employ a plurality of activation techniques such that the alarm will be activated with either the object attached to the alarm, or the alarm itself is being tampered with. One such device is disclosed in the U.S. Pat. No. 3,924,254 to Klebold et al who teaches an alarm system having a motion sensitive switch to detect motion of the alarm device and an anti-tamper coil which activates the alarm when the power supply to the alarm device is tampered with. However, the anti-tamper section of the Klebold device requires a constant application of energy to a coil, thereby creating a relatively high power drain in a quiescent state. Furthermore, while the prior art systems such as the Klebold system may provide a separate means for detecting the removal of power from the alarm, they do not provide a separate means for detecting the removal of a ground path for the circuitry in the alarm.

SUMMARY OF THE INVENTION

The present invention both avoids the high power drain associated with the prior art systems and further provides a separate means for detecting the loss of a ground path to the alarm device.

More specifically, the present invention is directed to an alarm device adapted to be mounted on an article to be protected, such as a painting, the alarm device being provided with tilt sensors to provide an alarm signal in the event that the object to be protected is moved, a power supply loss detecting circuit for providing an alarm in the event of a loss of power to the alarm unit, and a ground path interruption detection circuit for detecting the loss of the ground path to the alarm device.

The subject invention further provides processing circuitry to process one of three alarm indications in such a manner as to produce a two frequency alarm signal for a variable and preselected amount of time.

BRIEF DESCRIPTION OF THE DRAWING

The sole FIGURE is a schematic illustration of the alarm device in accordance with the preferred embodiment of the present invention.

DETAILED DESCRIPTION OF THE INVENTION

The alarm in accordance with the present invention is comprised of four subsections providing sensor, signal generation, timing, and alarm functions. The sensor section receives a +4 volt supply from an external or internal source, such as a mercury battery source, and delivers the four volts along a first path through 22K resistors R1 and R2 to the input of inverting Schmitt trigger 14. Between R2 and the input to Schmitt trigger 14 are a 6.8 megohm resistor to ground, a 0.01 pf disk capacitor, and a pair of biasing diodes 12 provided in order to maintain the input to inverting Schmitt trigger 14 within 0 to +4 volts. A ground path is provided between resistors R1 and R2 through mercury switches 10 to ground. The ground path is also applied through 22K resistor R3 to the input of another inverting Schmitt trigger 22. Between resistor R3 and the input of inverting Schmitt trigger 22 is a network comprising diodes 20, a 6.8 megohm resistor and a 0.01 pf disk capacitor each coupled to the +4 volt supply on the one hand, and to the input of inverting Schmitt trigger 22 on the other hand. The inverting Schmitt trigger 14 has an output applied to another inverting Schmitt trigger 16. The outputs from Schmitt triggers 16 and 22 are delivered to AND gate 18.

The output of AND gate 18 is delivered to a bi-stable flip-flop 24 comprised of a plurality of NAND gates 26, 28 and 30, and a 22K feedback resistor. A manual reset 25 is provided for the flip-flop.

The signal generator has a pair of frequency sources comprising inverting Schmitt triggers 42 and 44 having feedback resistors of 1.78 megohms and 2.37 megohms, respectively. The outputs of the frequency sources are applied to AND gates 32 and 34, respectively, the AND gates 32 and 34 also receiving a signal from the bistable flip-flop and a signal from the timing unit via inverting Schmitt trigger 43. The outputs of AND gates 32 and 34 are delivered to NAND gate 40 via inverters 36 and 38, respectively. The NAND gate 40 drives a plurality of inverting buffers in the current booster 46 to provide an adequate current supply to the alarm section.

The alarm section comprises a transistor 48 receiving the signal generated by the signal generator through a 1K base resistor to thereby provide the requisite power to alarm transducer 50 through a 68 ohm resistor. The same signal from the signal generator may also be applied to a remote amplifier output through a 15K resistor and 0.1 $\mu$f capacitor.

The timing section comprises two integrated circuits, one being a dual "D" type flip-flop, such as the CD 4013, and the other a 14 stage binary counter such as the CD 4020. The dual "D" type flip-flop, when connected using the pin connections as illustrated in the Figure, acts as a pair of divide-by-2 circuits 52 and 54. Briefly, pin 1 of the CD 4013 is tied to pin 11, pin 2 is tied to pin 5, pin 3 receives a clock input from the signal generator, pins 4, 6 and 10 are grounded, and pin 9 is connected to pin 12. The binary counter 56 receives a clock input at pin 10 from one of pins 3, 2 or 12 of dividers 52 or 54, and also receives a reset input from the bistable circuit 24 via inverter 58. The timing section provides an input to the signal generator from pin 12, and a signal to the bistable flip-flop 24 from pin 3 of the binary counter 56.

In operation, it can be seen that the sensor section provides an initial high voltage to the input of Schmitt trigger 14 from the +4 volt supply through resistors R1 and R2. The +4 volt supply is regulated by means of biased diodes 12. In the event that the object upon which the alarm is moved or disturbed in any way so as to complete the connection through one of mercury switches 10, the input to the Schmitt trigger 14 will be applied to ground through resistor R2 and mercury switches 10. This causes the normally low signal applied to the input of Schmitt trigger 16 to go high, thereby causing the normally high output of Schmitt trigger 16 to go low, which in turn produces a low level at the output of AND gate 18 to indicate an alarm condition.

The sensor section can also provide an alarm indication whenever the supply voltage path is interrupted along the path A-B, for example. The normally high input to Schmitt trigger 14 will be interrupted as the residual voltage at the input to Schmitt trigger 14 is drawn to ground through the 6.8 megohm resistor. The change of state is propagated through Schmitt triggers 14 and 16, and AND gate 18 as described above.

Finally, the alarm may be activated by the disruption of the ground path at C-D, for example. The input to the Schmitt trigger 22 is normally close to 0 volts due to the large ratio of the 6.8 megohm resistor to resistor R3. However, as the ground path C-D is removed, a +4 volt supply will be delivered to the input of Schmitt trigger 22 thereby providing a change in state to Schmitt 22 and AND gate 18 to provide the alarm indication to the flip-flop 24.

The change of state detected by the flip-flop 24 is delivered from the output of NAND gate 26 to AND gates 32 and 34 in the signal generator so that one of the two AND gates 32 or 34 will be enabled to pass either the 1200 Hz signal delivered from Schmitt trigger 42 or the 1500 Hz signal delivered from Schmitt trigger 44. The AND gates 32 and 34 receive inverse signals from the Q9 output of the counter 56 by virtue of the inverting Schmitt trigger 43. Therefore, as Q9 changes state during the alarm period, control will alternatively be switched from AND gates 32 and 34 in order to alternatively apply a 1200 and 1500 Hz signal to the alarm. The outputs of AND gates 32 and 34 are combined and NAND gate 40 via inverters 36 and 38. The output of 40 is applied to a plurality of inverting buffers 46 in order to provide sufficient current to drive the alarm. The output of NAND gate 26 in flip-flop 24 is also applied to reset counter 56 via inverter 58.

The clock input to counter 56 receives a signal from one of three sources, the first of which is received directly from the 1500 Hz source provided by Schmitt trigger 44 at lead 8T. The 14 bit binary counter 56 will count through its entire 14 bits at the rate provided by the 1500 Hz source. Upon counting through the entire 14 bits, the state of the 14th bit will change and will provide an output on pin 3 of counter 56. The output on pin 3 is applied to reset the flip-flop 24, which in turn removes the enabling signal from AND gates 32 and 34. It can also be seen that as the counter 56 counts through the entire 14 bits, the state of bit Q9 will repetitively change to thereby provide the alternating enabling signals to AND gates 32 and 34.

The second clock input to counter 56 is delivered at lead 16T from pin 2 of the CD 4013 and corresponds to the 1500 Hz signal divided by 2 in divider 52. Thus, when pin 10 of the CD 4020 is applied to lead 16T, the frequency applied to the clock input of the counter 56 will be one-half that as in the former case and it will take twice as long for the counter 56 to count through the entire 14 bits. Thus, the alarm will sound for twice as long when the clock input receives the signal at lead 16T.

Finally, the second divide-by-2 counter 54 receives the divided output from the first divide-by-2 circuit 52 to provide a signal at one-fourth the frequency of the 1500 Hz input signal. Therefore, when the input to counter 56 receives the signal on lead 32T, the alarm will sound four times as long as when the clock input directly receives the 1500 Hz signal.

Thus, upon either tilting or moving the protected object, or upon a disruption of either the voltage supply or the ground path, the alarm in accordance with the present invention will provide a two-frequency "wailing" type alarm for a variable amount of time which may be easily preselected.

Various changes, additions and omissions of elements may be made within the scope and spirit of this invention. It is to be understood that the invention is not limited to specific details, examples and preferred embodiments shown and described herein.

What is claimed is:

1. An alarm adapted to be mounted on an object to be protected comprising:

first and second terminal signals, one of said first and second terminal signals being ground, the other at a potential with respect thereto;

first means (14) having two states and receiving at least a portion of said first terminal signal when said object remains fixed;

means (10) for applying at least a portion of said second terminal signal to said first means when said object is moved;

second means (22) in parallel with said first means, having two states, and receiving at least a portion of said second terminal signal;

means for applying at least a portion of said second terminal signal to said first means when a connection between said first terminal and said first means is disrupted;

means for applying at least a portion of said first terminal signal to said second means when a connection between said second terminal and said second means is disrupted;

whereby one of said first and second means changes state to signal an alarm to indicate:

(i) a movement of the protected object, (ii) a disruption of said first terminal signal, or (iii) a disruption of said second terminal signal.

2. The alarm of claim 1 wherein said first means is followed by a third means (16) having two states, and each of said first, second, and third means function to invert the input state.

3. The alarm of claim 2 wherein said first, second and third means are inverting Schmitt triggers.

4. The alarm of claims 1 or 2 wherein said means for applying at least a portion of said second terminal signal to said first means when said object is moved comprises switch means activated by a change in position of said object.

5. The alarm of claim 4 wherein said switch means comprises at least one mercury switch.

6. The alarm of claim 1 or 2 wherein said means for applying at least a portion of said second terminal signal to said first means when a connection between said first terminal and said first means is broken comprises resistive means coupled between the input of said first means and said second terminal.

7. The alarm of claims 1 or 2 wherein said means for applying at least a portion of said first terminal signal to said second means when a connection between said second terminal and said second means is broken comprises resistive means coupled between the input to said second means and said first terminal.

8. The alarm of claim 1 wherein said means for applying at least a portion of said second terminal signal to said first means when said object is moved comprises switch means activated by a change in position of said object;

said means for applying at least a portion of said second terminal signal to said first means when a connection between said first terminal and said first means is broken comprises resistive means coupled between the input to said first means and said second terminal;

and said means for applying at least a portion of said first terminal signal to said second means when a connection between said second terminal and said second means is broken comprises resistive means coupled between the input to said second means and said first terminal.

9. The alarm of claims 1, 2 or 3 wherein said second terminal signal is ground and said first terminal signal is a potential with respect to ground.

10. The alarm of claim 4 wherein said second terminal signal is ground and said first terminal signal is a potential with respect to ground.

11. The alarm of claim 6 wherein said second terminal signal is ground and said first terminal signal is a potential with respect to ground.

12. The alarm of claim 7 wherein said second terminal signal is ground and said first terminal signal is a potential with respect to ground.

13. The alarm of claim 8 wherein said second terminal signal is ground and said first terminal signal is a potential with respect to ground.

14. An alarm having a voltage and ground applied thereto and adapted to be mounted on an object to be protected comprising:

(a) a sensor unit for detecting and producing an alarm signal in response to:

(i) movement of the protected object, (ii) a disruption of said voltage applied to said alarm, or (iii) a disruption of said ground applied to said alarm;

(b) memory means providing an enable signal is response to said alarm signal;

(c) timing means for providing timing signals and for resetting said memory means, said timing means comprising a counter means for resetting said memory means and for selectively controlling said plurality of tones, and dividing circuit means for selectively applying clock signals to said counter means whereby the amount of time said alarm tones are generated depends on the source of said clock signals; said dividing circuit means comprising a pair of divide-by-two circuits connected in cascade, said clock signals derived from one of (i) the input to said dividing circuit means, (ii) the output of the first of said pair of divide-by-two circuits, and (iii) the output of the second of said pair of divide-by-two circuits;

(d) tone generating means enabled by said memory means for providing at least one alarm tone and providing a plurality of tones to said alarm transducer under the selective control of said timing signals; and (e) an alarm transducer for sounding an alarm in response to said at least one alarm tone.

15. The alarm of claim 14 wherein said memory means comprises a flip-flop.

16. The alarm of claim 14 wherein said input to said divide-by-two circuit means is taken from said tone generating means.

* * * * *